United States Patent [19]

Darwin

[11] 3,986,281

[45] Oct. 19, 1976

[54] SAFETY SYSTEM FOR PRESSERS

[76] Inventor: Frank S. Darwin, 6821 Haverhill Drive, Knoxville, Tenn. 37901

[22] Filed: July 16, 1975

[21] Appl. No.: 596,363

[52] U.S. Cl. ..... 38/17; 38/27; 38/41; 192/129 B; 192/130; 192/133

[51] Int. Cl.[2] ..... D06F 71/00

[58] Field of Search ..... 38/1 R, 17, 27, 40, 38/41; 192/129 R, 129 B, 130, 131 R, 132, 133, 134

[56] References Cited

UNITED STATES PATENTS

| | | | |
|---|---|---|---|
| 2,472,656 | 6/1949 | Forse | 38/27 |
| 2,703,939 | 3/1955 | Clarke | 38/41 |
| 3,333,355 | 8/1967 | Tucker | 38/27 |
| 3,640,007 | 2/1972 | Richterkessing | 38/41 |
| 3,722,116 | 3/1973 | Beeley et al. | 38/27 |

*Primary Examiner*—Geo. V. Larkin
*Attorney, Agent, or Firm*—John A. Hamilton

[57] ABSTRACT

A safety system for garment pressers which have a head movable against a buck with a garment therebetween and steam vents opening through the head and buck, the safety system being operable to deactivate the press and raise the head in the event the operator's hand or arm should be caught in the press, and including an involuntary safety comprising a bar movable relative to the press during normal operation to engage a portion of the operator's hands or arms, if caught in the press, regardless of the attitude of the hands or arms, mechanism operable by such engagement to deactivate the press, possibly also including a voluntary, manually operable safety for deactivating the press intentionally, and a device for preventing either the involuntary or voluntary safety devices from being used to shorten the pre-set pressing cycle time to gain production at the expense of quality.

9 Claims, 5 Drawing Figures

SAFETY SYSTEM FOR PRESSERS

Figure 1:
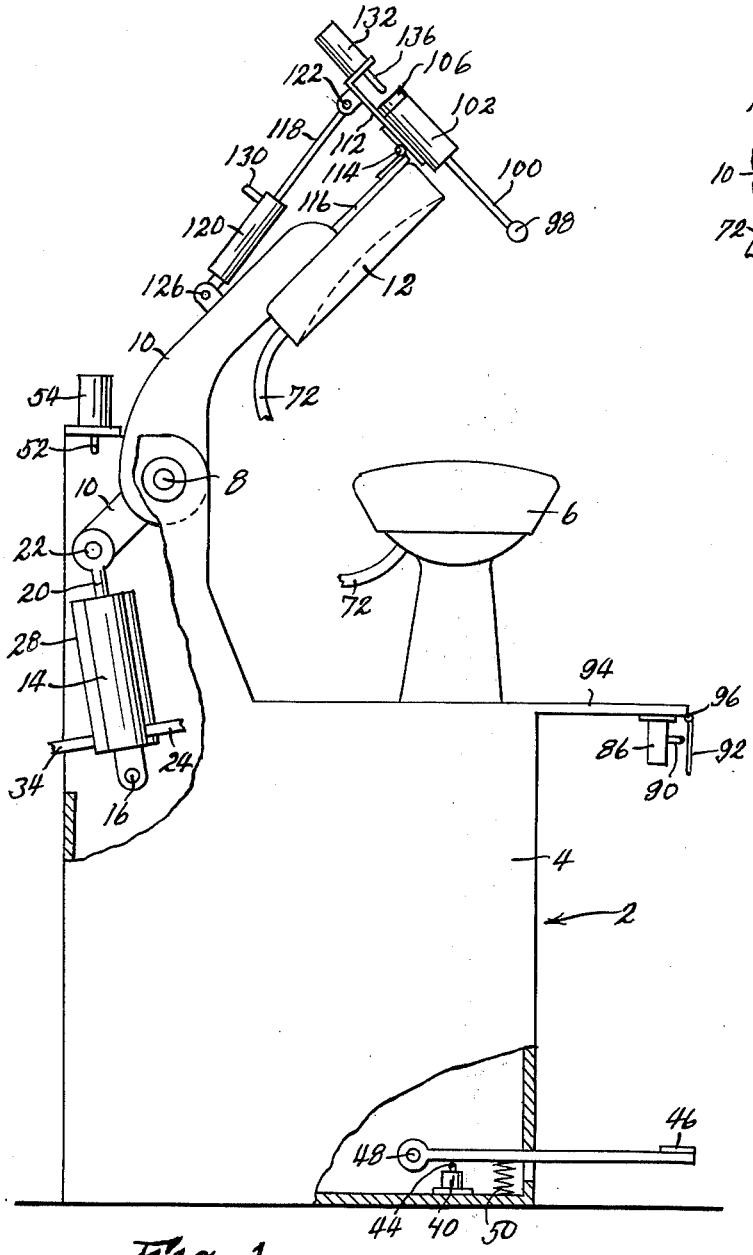

This invention relates to new and useful improvements in garment pressing equipment, and has particular reference to a safety system for use in connection with such equipment.

In garment pressers commonly used in the garment production industry, a garment is laid over the buck, a head is lowered to press the garment firmly between the head and the buck, and pressurized steam is introduced through perforations of the head and buck. A normal cycle would be that the operator, after arranging the garment on the buck, depresses a foot pedal, which actuates power means for lowering the head against the garment and buck, pressing the head down with substantial mechanical pressure, supplying steam for a pre-determined time, then shutting off the steam and raising the head. The entire cycle is automatic, and would be irreversible once initiated if it were not for safety devices for interrupting it, and the operator could suffer injury if his hands or arms are caught in the press as it closes. That is, his hands or arms would not be crushed, the buck or the head, or both, having yieldable surfaces, but the closing pressure is sufficient to prevent him from withdrawing his arm, and he may suffer extremely painful burns from the steam during the time, often five or six seconds, the press is closed.

To prevent such injury, such presses are customarily provided with a voluntary safety device, which he may activate with some portion of his body, which shuts off the steam and raises the head. However such voluntary safety devices are increasingly becoming considered inadequate, since the operator may be incapacitated by pain and panic from using them. Therefore, while they are still commonly used, for instance to interrupt the cycle for some other proper reason, some type of involuntary safety device which operates automatically without cooperation from the operator is being recommended, and is or will be required by safety regulations. Various types of involuntary safety devices have been proposed, but for various reasons have been less than completely successful. For example, systems requiring use of both of the operator's hands, of course at positions precluding the presence of his hands or arms in the press, to activate the pressing cycle, have been tried. However, these systems, while providing safety, do require additional time and therefore reduce production, and have not been well received either by operators or by management. Another type of system proposed has involved the use of electronically actuated sensing devices, such as wires, arranged about the periphery of the press head and operable to deactivate the press whenever they contact the operator's skin, which they should do if his hand is caught in the press. However, devices of this type are sometimes falsely triggered by steam from the press, and if the operator wears long sleeves, the device cannot engage his skin and will not function when needed. Mechanical safeties, including members movable on the head by engagement thereof with the operator's hands or arms to deactivate the press, appear to offer the best possibilities, but even this type has been subject to the difficulty of so selecting a position for the movable safety member that it will engage a portion of the operator's anatomy reliably and virtually infallibly, regardless of the position or attitude of his hands, arm and body.

Accordingly, an object of the present invention is the provision of an involuntary safety device which solves all of the above enumerated difficulties and shortcomings of prior devices. The present device is basically mechanical in nature, involving a safety bar carried movably by the press head, whereby to be engaged and moved by contact with the operator's arm or hand to deactivate the press, if his hand or arm is caught in said press. However, to prevent any possibility that, due to any strained or unnatural position of the operator's body, the safety bar might fail to engage and be triggered by this body, the safety bar is given an additional "scanning" movement relative to the press head, by separate power means, whereby it will "seach for and find" some portion of the arm, hand or fingers of the operator if he is caught in the press, regardless of the attitude of his body.

Another general difficulty experienced with safety devices, whether of the voluntary or involuntary type, is that many operators customarily abuse them by actuating them intentionally to shorten the pre-set cycle time of the press. This allows them to increase production, but at the expense of quality of work, and is a highly objectionable practice. Accordingly, another object of the present invention is the provision of means for preventing this practice, which provides that once the press cycle has been initiated, it can be interrupted and the press deactivated by actuation of any of the safety devices, but that a next press cycle cannot be initiated until a manually operable reset device is actuated. This reset device may be positioned sufficiently remotely from the press that the time required for the operator to actuate it will eliminate any possible time advantage he might otherwise gain from "short-cycling" the press, and the practice is thereby discouraged.

Other objects are simplicity and economy of construction, and efficiency and dependability of operation.

Figure 2:
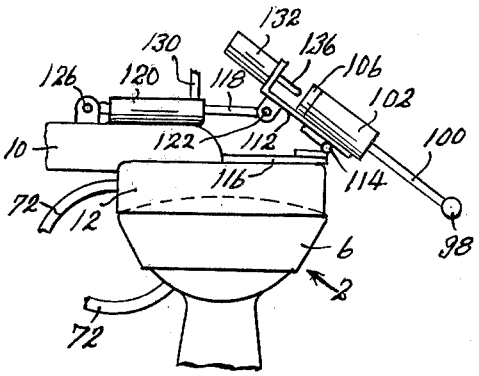
Figure 4:
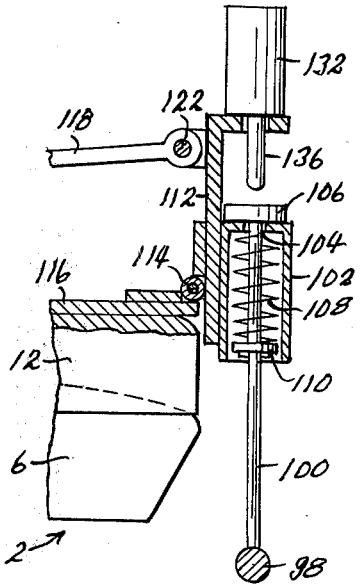
Figure 3:
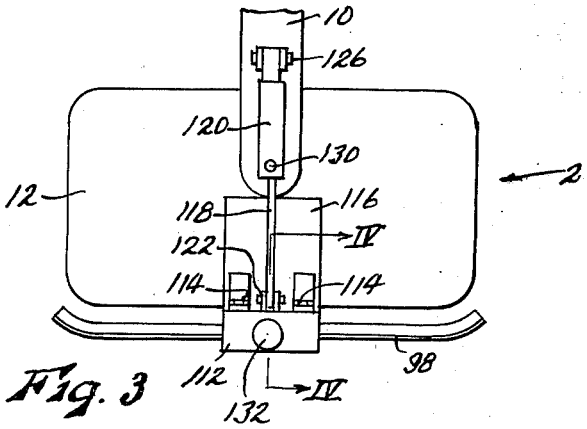
Figure 5:
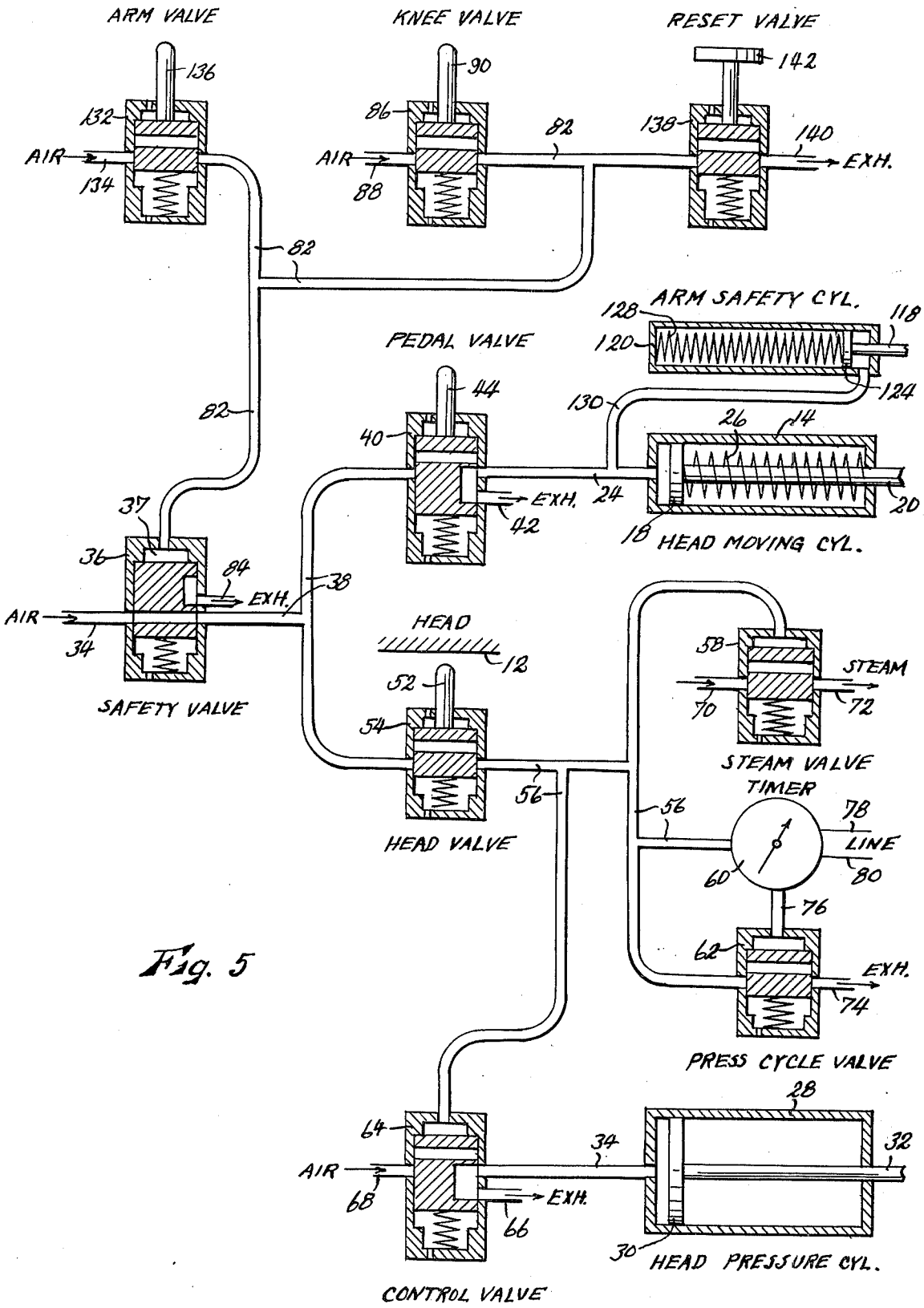

With these objects in view, as well as other objects which will appear in the course of the specification, reference will be had to the accompanying drawing, wherein:

FIG. 1 is a side elevational view of a garment pressing machine, partially broken away, and shown in its open position, FIG. 2 is a fragmentary view similar to FIG. 1, but showing the press in its closed position and with the involuntary safety bar extended, FIG. 3 is a top plan view of the elements shown in FIG. 2, but with the involuntary safety bar retracted, FIG. 4 is an enlarged, fragmentary sectional view taken on line IV—IV of FIG. 3, and FIG. 5 is a diagrammatic layout of the control and operating system of the press and its safety devices.

Like reference numerals apply to similar parts throughout the several views, and the numeral 2 applies generally to a garment pressing machine of ordinary design including a floor-supported base 4 having mounted thereon the buck portion 6 over which garments to be pressed may be laid. Pivoted to the base at 8 is an arm 10 which carries at its free end the head portion 12 of the press, the head being adapted by pivotal movement of the arm to be moved between a press-open position spaced well above buck 6, as shown in FIG. 1, to a press-closed position against the buck, as shown in FIG. 2. The press is adapted to be closed by operation of a pneumatic ram 14 pivoted in base 4 at 16 and having a piston 18 (see FIG. 5) fixed to an extending piston rod 20 pivoted at its free end to arm 10, as at 22. Head 12 is lowered to close the press by extension of ram 14 by air pressure from air conduit 24, and the ram is retracted by a spring 26 therein, whereby to raise the head to open the press, whenever air pressure in ram 14 is relieved. The press is held closed with the total force required for efficient pressing, which is substantially greater than that required from ram 14 simply to close the press, by a second pneumatic ram 28, which is pivoted in base 4 coaxially with pivot 16, and which includes a piston 30 fixed to a piston rod 32 pivoted at its free end to press arm 10. This ram may be of larger diameter than ram 14, or may be supplied with air through conduit 34 from a source of higher pressure, in order to supply the higher press-closing force required.

Air for operating ram 14 is supplied from a source of suitable pressure, not shown, through conduit 34 and a normally open safety valve 36 to conduit 38, and thence to inlet conduit 24 of ram 14 through a pedal valve 40. Pedal valve 40 is normally closed, as shown in FIG. 5, and in this position exhausts conduit 24 to atmosphere at 42, so that press head 12 is normally raised by spring 26, but has an operating member 44 adapted to be engaged and actuated, by depression of a foot pedal 46 pivoted in base 4 at 48 and normally elevated by spring 50. Thus, whenever the pedal is depressed by the operator, valve 40 is operated to seal exhaust 42 and supply air to ram 14, whereby said ram is extended to lower the head to its closed position. Whenever pedal 46 is released, valve 40 is closed and ram 14 is exhausted at 42, so that the head is raised to its open position by spring 26.

As head 12 reaches its closed position, some portion thereof, such as arm 10, engages the operating member 52 of a head valve 54, whereby to open said valve. Said head valve is normally closed. It receives air from conduit 38 under the control of safety valve 36, and when open, delivers air to conduit 56, which in turn delivers air to a steam control valve 58, a timer 60, a press cycle valve 62, and a control valve 64 for ram 28. Control valve 64 has a normal closed position, as shown, exhausting ram 28 to atmosphere at 66, but is operable by air delivered thereto by conduit 56 to move to an open position wherein exhaust 66 is sealed and air from a suitable source 68 is delivered to ram 28, whereby the press is held closed with whatever pressure may be required. As noted above, source 68 may be either the same or independent from source 34.

Steam valve 58 is normally closed, but is operable to be opened by air pressure in conduit 56, whereby to deliver pressurized steam from a suitable source, not shown, through a conduit 70 and the valve to conduits 72, which it will be understood deliver said steam through perforations formed in the mating surfaces of buck 6 and head 12. Cycle valve 62 is a normally closed exhaust valve, exhausting to atmosphere at 74 when opened. It is operable to be opened by air pressure delivered thereto by timer 60 through conduit 76. Timer 60 may be basically electric, being supplied with electric current by line wires 78–80, but includes valve means operable to deliver air from conduit 56 to conduit 76 a pre-set time, often 5 or 6 seconds, after pressure is supplied in conduit 56. Timers of this type are known in the art, and the construction thereof is therefore not shown here in detail. Thus, once head valve 54 is opened, the press is held closed by the full force of ram 28, and steam is supplied thereto, until the pre-set cycle time of timer 60 has elapsed. It cannot be interrupted by releasing pedal 46 to exhaust ram 14. If the operator's hand or arm is caught in the press, severe and painful burns would result, were it not for the safety devices to be described. Of course, once the pre-set cycle time of timer 60 has elapsed, the timer delivers air to open valve 62, which exhausts conduit 56 to the atmosphere, allowing steam valve 58 to assume its normal closed position to shut off the steam supply to the press, and allowing control valve 64 to close to exhaust ram 28 at 66, so that the press head is elevated by spring 26. This is a normal operating cycle, such as would occur whenever the operator does not catch his hand or arm in the press, which could result in serious burn injury before the normal cycle had elapsed.

To prevent this type of mishap, two safety devices are illustrated, one voluntary and one involuntary. Both utilize safety valve 36, which as shown is normally open to deliver air for controlling the rams and steam valve in normal cycles, but is movable by air pressure delivered to a control chamber 37 thereof by a conduit 82 to a closed position in which air source 34 is sealed off, and all elements downstream from said valve are exhausted to atmosphere at 84. Thus whenever valve 36 is closed, ram 14 will be exhausted at 84 even if pedal valve 24 is open, and the operating pressure of steam valve 58 and control valve 64 will be relieved even if head valve 54 is open and cycling valve 62 is closed, so that the steam supply is shut off and the press opened.

The voluntary safety as shown is already in general use, including a normally closed knee valve 86 which receives air from a source of suitable pressure at 88, and delivers said air, when open, to conduit 82 to close safety valve 36. Valve 86 has an operating member 90 adapted to be engaged and moved to open said valve by a flap 92 extending across the front of the press and hingedly supported from the "table" portion 94 of press base 4 at 96, and disposed at an elevation above the floor convenient to the operator's knees or thighs. Thus the operator can deactivate the press at any time, by the voluntary action of deflecting flap 92 rearwardly. However, as previously noted, this type of safety has proved inadequate and objectionable for at least two reasons. First, if he has a hand or arm caught in the press, he is often incapacitated by reason of his extreme pain and panic from actuating the flap voluntarily. Second, many operator's develop the practice of using the flap to artificially "short-cycle" the press, which improves his production volume, but at the expense of quality. Nevertheless, the provision of a means for intentionally deactivating the press has legitimate usages, for example for the purpose of rearranging the garment on the buck if the press should close with the garment folded, creased or otherwise wrongly positioned on the buck.

To prevent the possibility of injury due to an operator's incapacity to use a voluntary safety device, an involuntary safety device is also provided. As shown, this device includes a safety bar 98 extending horizontally just forwardly of the press head. Extending upwardly from the midpoint of said safety bar is a rod 100, which projects upwardly through a tubular sleeve 102 and through a perforation 104 at the top of said sleeve, having at its top end an enlarged head 106 which cannot pass through the perforation and therefore supports the safety bar against downward movement, although said bar can be deflected upwardly against a spring 108 carried in said sleeve and compressed between the top end wall of said sleeve and a collar 110 fixed on rod 100. Sleeve 102 is fixed to a normally vertical plate 112 which in turn is hinged, as at 114, to a mounting plate 116 fixed to the top of press head 12. Plate 112 extends above the press head, and the piston rod 118 of a pneumatic ram 120 is pivoted to its upper portion, as at 122. The piston rod extends rearwardly, being connected to the piston 124 of ram 122, which in turn is pivoted to some fixed portion of the press head, such as arm 10, as indicated at 126. The piston rod is normally held in an extended position by a spring 128 carried within the ram cyclinder, whereby safety bar 98 is normally positioned in a retracted position, parallel to the lower forward edge of the press head as shown in FIGS. 1 and 4. By supplying air to ram 120 through conduit 130, piston 124 is retracted against spring 128 to pivot safety bar 98 outwardly and upwardly from the press head to an extended position as shown in FIG. 2, wherein it is positioned approximately in the plane of the lower face of the press head, but substantially forwardly thereof. Supply conduit 130 of ram 120 is connected into supply conduit 24 of ram 14. Mounted on pivot plate 112 is an "arm" valve 132 which receives air at 134 from any suitable pressure source, and when open supplies said air to conduit 82. Valve 132 is normally closed, but is supplied with an operating member 136 adapted to be engaged and moved to open said valve by head 106 of supporting rod 100 of safety bar 98, whenever said safety bar is deflected upwardly relative to sleeve 102. Opening of valve 132 supplies air pressure to close safety valve 36 to deactivate the press, as previously described in connection with lever valve 86.

Thus it will be seen that whenever padal 46 is depressed to activate the press as previously described, pedal valve 40 will supply air to ram 120 as well as to ram 14, thereby causing safety bar 98 to be moved to the extended position of FIG. 2, as the press head moves to its closed position. If the operator's hands or arms are caught in the closing press, the safety bar will engage his arm or arms, and be deflected upwardly against spring 108 and will open arm valve 132 to deactivate the press as described above, without requiring any voluntary action by the operator. It is desirable that the safety bar engage the forearms rather than the fingers or hands, since the latter may be painful in itself if the press closes rapidly, while the forearms are relatively well padded by thick muscles. On the other hand, it is desirable that the safety bar be retracted when the head is raised, in order to be out of the operator's way as much as possible as he arranges garments on the buck. These considerations are one reason for the extension-retraction movements of the safety bar. Another and more important reason is evident from the fact that while the safety bar moves to its extended position as the press head is lowered, it is immediately retracted by spring 128 as soon as pedal valve 24 is closed by release of pedal 46 to vent ram 120, while the press is still held closed by ram 28. Thus if the operator's hand is caught in the press as it closes, and safety bar 98 misses his arm when in its extended position, which could occur for example if the operator should bend his arms sharply downwardly at the wrists, so that his forearms were positioned too low to be engaged by the safety bar in its extended position, then the subsequent downward and rearward movement of the safety bar, which occurs when he releases pedal 46, which he would release instinctively if his hand were caught, would cause said safety bar almost inevitably to engage and be deflected by the arms or hands of the operator at some time during the retracting movement of the safety bar. Thus, this "hunt and find" movement of the safety bar contributes materially to the efficiency of the device. The "scanning" movement thereof, both vertically and also forwardly and rearwardly of the press, renders it virtually impossible that said safety bar will not engage and be actuated by some portion of the operator's anatomy at some stage of the movement.

While the voluntary safety action of knee valve 86 provides for intentional deactivation of the press whenever desired, in emergency conditions or not, and while arm valve 132 provides a virtually foolproof automatic and involuntary deactivation of the press in the event the operator is incapacitated by pain or panic from using the voluntary safety, there remains the problem that either safety device can, and often is, abused to shorten the pressing cycle pre-set by means of timer 60. This intentional "short-cycling" increases production, but only at the expense of reduced quality. To prevent this practice, there is provided a "short cycle inhibitor" including a reset valve 138. This valve is normally closed, its inlet being connected into conduit 82, and its outlet being exhausted to atmosphere at 140. It may be opened by manual depressing of its operating pushbutton 142. It will be seen that whenever the knee safety valve 86 or the arm safety valve 132 is opened to deactivate the press, as already described, and then reclosed, air under pressure is trapped in conduit 82, and therefore retains control valve 36 closed so that the press cannot be operated, as long as the air pressure in conduit 82 remains elevated. Thus the press cannot be reactuated until pushbutton 142 is depressed momentarily to exhaust conduit 82 to the atmosphere to allow control valve 36 to reopen. It is contemplated that reset valve 138 be positioned sufficiently far away from the press, or otherwise rendered sufficiently inaccessible, that the time required for the operator to gain access thereto and press the pushbutton will completely cancel any time advantage he might otherwise gain from using the safety devices to short-cycle the press. This of course may be done by so placing the reset switch that access thereto requires more time then the normal five of six seconds pre-set by timer 60.

The operation of the safety system forming the subject matter of the present invention is believed to have been described fully and completely in the foregoing description of its structure and arrangement. It will be seen to accomplish the objects of the invention in an efficient and economical manner. It provides a manually operable, voluntary safety device for deactuating the press intentionally, or in less than extremely critical emergency conditions. It provides a second fully automatic, involuntary safety device for deactivating the press in conditions of extreme emergency which does not require any voluntary action by the operator, since he may be incapacitated to use the voluntary device by pain and panic if he has been caught in the press. It prevents the operator from abusing either safety device to short-cycle the press.

While I have shown and described a specific embodiment of my invention, it will be readily apparent that many minor changes of structure and operation could be made without departing from the spirit of the invention.

What I claim as new and desire to protect by Letters Patent is:

1. In a pressing machine including a buck on which atricles to be pressed may be arranged, and a head movable downwardly to a closed position against said buck, said buck and head having steam holes provided in the mating surfaces thereof, and including manually activated operating means operable when actuated to close said head against said buck, maintain it thereagainst for a predetermined time period while delivering steam to the holes of said buck and head, then shut off said steam and open said press, all in an automatically controlled, predetermined cycle, a safety system comprising:

a. deactivating means operable when actuated to interrupt said operating cycle by shutting off said steam and opening said press, a safety member carried movably by said press head and having mutually independent primary and secondary movement relative to said head, being operable by said primary movement to actuate said deactivating means, said safety member being disposed relative to said press head at such a position that it engages and is moved in its primary movement relative to said head by the hand or arm of the operator if said hand or arm was caught in the press as it closed, and wherein said secondary movement of said safety member relative to said head constitutes or arm was caught in the press as it closed, and wherein said secondary movement of said safety member relative to said head constitutes a scanning pattern relative to said head as and after said head is closed, whereby to find and engage the operator's hands or arms regardless of the attitude of said hands and arms, said safety member remaining operable at all positions of said secondary scanning movement to actuate said deactivating means by means of the primary movement thereof when it engages the operator's body, and c. scanning means initiated by manual initiation of said operating means to initiate the secondary movement of said safety member.

2. A presser safety system as recited in claim 1 wherein said press is adapted to be loaded with articles to be pressed from the front thereof, said safety member constituting a horizontally extending bar extending transversely forward of said presser head, normally below the level of the lower face of said head, said secondary scanning movement thereof comprising an upward and forward movement thereof as said head is lowered by said operating means, and a return movement after said head is lowered, and the primary movement thereof constituting an upward movement thereof relative to said head.

3. A presser safety system as recited in claim 1 wherein said safety member bar is carried by a normally vertical rod longitudinally movable in a sleeve carried by said head for pivotal movement on a horizontal transverse axis, movement of said rod in said sleeve serving to actuate said deactivating means, and pivotal movement of said sleeve serving to provide said secondary scanning movement of said safety bar.

4. A presser safety system as recited in claim 1 wherein said operating system is pneumatically operated, including an air cylinder operable by air under pressure supplied thereto to lower said press head to its closed position, through a manually operable valve having a closed position in which said cylinder is vented to atmosphere, a second cylinder also supplied with air from said valve and operable to move said safety member in one direction of its secondary scanning movement, both of said cylinders having spring returns for respectively raising said head and moving said control members in its return scanning movement when they are vented to atmosphere, a second normally closed valve receiving air under pressure and operable to be opened by said head as it reaches its lowered position to deliver air to a third cylinder to hold said head closed after said first valve is closed and the first two cylinders are vented, and to a timer actuated by pneumatic pressure to open a fourth valve to exhaust the system downstream from said second valve after a pre-set cycle time; and wherein said deactivating means constitutes a third normally open valve disposed in the air supply line to said first and second valves, said third valve having a closed position to which it may be moved by air pressure supplied to an operating chamber thereof, and in which the air line downstream therefrom is vented to atmosphere, and a fourth normally closed valve operable when opened to deliver air under pressure to the operating chamber of said third valve to close and vent the latter, said safety member being operable by the primary movement thereof relative to said head to open said fourth valve.

5. A presser safety system as recited in claim 3 with the addition of:

a. a second safety member carried by said press for voluntary manual movement thereof relative to said press, and b. a fifth normally closed valve operable when open to deliver air under pressure to the operating chamber of said third valve to cause closure and venting of the latter.

6. A presser safety system as recited in claim 3 wherein closure of said fourth valve by release of said safety member traps air under pressure in the operating chamber of said third valve, maintaining the latter closed and vented, and with the addition of a normally closed, manually operable reset valve operable when opened to vent the operating chamber of said third valve to the atmosphere.

7. A presser safety system as recited in claim 6 with the addition of:

a. a second safety member carried by said press for voluntary manual movement thereof relative to said press, and b. a fifth normally closed valve operable when open to deliver air under pressure to the operating chamber of said third valve to cause closure and venting of the latter.

8. A presser safety system as recited in claim 1 with the addition of short cycle inhibiting means comprising:

a. releasable reset means operable to prevent deactuation of said deactivating means, once it has been acutated, and b. manually operable release means operable to release said reset means to permit deactuation of said deactivating means, said release means being sufficiently inaccessible to the operator that the press-closed time set into the normal operating cycle of the press will have elapsed before said release means can be operated.

9. A presser safety system as recited in claim 5 with the addition of a secondary safety member carried movably by said press and manually movable by the operator to voluntarily actuate said deactivating means, said reset means being operable to delay deactuation of said deactivating means when it was actuated by either of said safety members.

* * * * *